US008128471B2

(12) United States Patent
Oomori

(10) Patent No.: US 8,128,471 B2
(45) Date of Patent: Mar. 6, 2012

(54) GAMING SYSTEM, GAMING MACHINE AND GAME CONTROL METHOD WITH COMPENSATION PROCESSING BASED ON LOWER LIMIT OF ODDS

(75) Inventor: Tomoaki Oomori, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 585 days.

(21) Appl. No.: 12/404,173

(22) Filed: Mar. 13, 2009

(65) Prior Publication Data

US 2009/0239600 A1 Sep. 24, 2009

Related U.S. Application Data

(60) Provisional application No. 61/038,957, filed on Mar. 24, 2008.

(51) Int. Cl.
*A63F 9/24* (2006.01)

(52) U.S. Cl. ..... 463/6; 463/27; 463/28; 463/31; 463/37; 463/42; 463/43

(58) Field of Classification Search ..... None
See application file for complete search history.

(56) References Cited

U.S. PATENT DOCUMENTS

| | | | | |
|---|---|---|---|---|
| 4,322,612 | A * | 3/1982 | Lange | 463/28 |
| 5,411,258 | A * | 5/1995 | Wilson et al. | 463/6 |
| 6,120,376 | A * | 9/2000 | Cherry | 463/16 |
| 6,139,430 | A | 10/2000 | Huard et al. | |
| 6,210,275 | B1 * | 4/2001 | Olsen | 463/16 |
| 6,358,150 | B1 * | 3/2002 | Mir et al. | 463/28 |
| 6,406,369 | B1 * | 6/2002 | Baerlocher et al. | 463/20 |
| 6,450,887 | B1 * | 9/2002 | Mir et al. | 463/42 |
| 6,695,701 | B2 * | 2/2004 | Aronson et al. | 463/28 |
| 6,780,110 | B2 * | 8/2004 | Baerlocher et al. | 463/20 |
| 6,848,991 | B2 | 2/2005 | Kusuda | |
| 6,875,104 | B2 * | 4/2005 | Hara | 463/6 |
| 7,070,499 | B2 * | 7/2006 | Ocampo | 463/6 |
| 7,582,013 | B2 * | 9/2009 | Asher et al. | 463/25 |
| 7,742,972 | B2 * | 6/2010 | Lange et al. | 705/37 |
| 7,883,411 | B2 * | 2/2011 | Vlazny et al. | 463/28 |
| 7,942,735 | B2 * | 5/2011 | Meyer et al. | 463/25 |
| 8,062,111 | B2 * | 11/2011 | Aronson et al. | 463/6 |
| 2007/0026940 | A1 * | 2/2007 | Cannella | 463/28 |
| 2007/0087825 | A1 * | 4/2007 | Hart et al. | 463/28 |

* cited by examiner

*Primary Examiner* — David E Graybill
(74) *Attorney, Agent, or Firm* — Lexyoume IP Group, PLLC

(57) ABSTRACT

In a racing game, a main controller 20 accepts bet from each of a plurality of terminal devices 30, during a bet accepting period. In a case where final odds, calculated after the expiration of the bet accepting period, is not greater than a predetermined threshold, the main controller 20 executes a recompense processing for bets on the final odds and disqualify the bets from an award, and, when a race is determined to be finished, provides an award by calculating payout for bets qualified for the award.

6 Claims, 12 Drawing Sheets

GAMING SYSTEM, GAMING MACHINE AND GAME CONTROL METHOD WITH COMPENSATION PROCESSING BASED ON LOWER LIMIT OF ODDS

CROSS REFERENCE TO RELATED APPLICATIONS

This application claims benefit of U.S. Provisional Application No. 61/038,957, filed Mar. 24, 2008, the entire contents of which are incorporated herein by reference.

BACKGROUND OF THE INVENTION

1. Field of the Invention

The present invention relates to a gaming machine that provides an opportunity for compensation processing on the basis of a lower limit of odds.

2. Related Art

Conventionally, racing games such as a horse racing game are known as games in which a plurality of characters race. In the invention disclosed in U.S. Pat. No. 6,848,991, a bet is made on a character selected from a plurality of characters and an award is provided on the basis of odds determined in advance for each character, in a case where the character has finished in a predetermined finishing order and has qualified for the award. However, players may bet on a stronger character, and thus the odds thereof are lowered for the character at the last minute. The players having bet to win may only receive their wager back, and only take risks with no gain, even in a case where the character takes first place.

In addition, slot machines having a plurality of stations and casino machines in which slot machines are connected with each other via a computer network that provide a progressive jackpot are conventionally known. The invention disclosed in U.S. Pat. No. 6,139,430 accumulates a part of the number of medals or a value (numerical data represented by a concrete or an intangible gaming medium) inserted by players, and pays out the total accumulated value to a player having won a jackpot. The progressive jackpot is different from a normal jackpot that does not involve the accumulation of bets, and can provide stronger incentive for the players of a slot machine or the like to participate in the game. However, qualifications for participating in the progressive jackpot are given to any player having inserted medals or the like, and are not particularly related to an operation of a gaming machine and to odds of a race. Thus, players are not allowed to participate in the progressive jackpot based on fluctuation of odds during a bet accepting period.

The present invention provides a gaming machine that provides an opportunity for participants not obtaining a profit and taking risks to participate in compensation processing that includes the progressive jackpot, in a case where odds are not greater than a specific value during a bet accepting period, thus providing more incentive for the players to participate in the game.

SUMMARY OF THE INVENTION

In a first aspect of the present invention, a gaming system is provided including: a display for displaying images relating to a racing game; a plurality of terminals having an input device for accepting a bet amount for each character that is input by a player in a timer-controlled accepting period, and outputting the bet amount accepted; a first memory for storing a bet amount for each of the terminals that is output by the input device; a second memory for storing a configuration program for setting odds associated with each of the characters; a controller for executing the racing game, and generating and displaying on the display a moving image in real time regarding progress of a race from beginning to end of the game; and a communication network device allowing intercommunication between the plurality of terminals and the controller, in which the controller executes steps of: (a) receiving a bet amount in a bet accepting period from the input device via the communication interface and storing the bet amount in the first memory, while calculating the odds for winning of each of the characters by using the configuration program stored in the second memory and displaying the calculated odds on the display, in response to the reception of the bet amount or regularly at predetermined intervals; (b) calculating the odds using the configuration program stored in the second memory upon expiration of the bet accepting period, paying back the bet amount to the station having placed a bet on the odds in a case where the odds are not greater than a predetermined threshold, and eliminating the bet for the odds from bets having qualified for an award; and (c) providing an award when a race is determined to be finished, based on a finishing order of the characters, a type of a bet made on each of the plurality of terminals, and an amount of a bet qualified for the award.

According to the first aspect of the present invention, the controller of the gaming system executes a racing game having recompense processing for players having made a bet, thus taking measures for the case where players cannot obtain profit due to low odds for a specific character. The controller calculates odds for each character in the racing game, in response to the reception of a bet amount from the plurality of terminals or repeatedly at predetermined intervals, during the bet accepting period, and then displays the odds to players. Then, in a case where there is a character having odds not greater than a predetermined value at the expiration of the bet accepting period, the controller pays back the bet amount for the character and excludes the bet amount from an award. In other words, the controller executes recompense processing for players in response to a situation where no profit is expected, and excludes the bet amount from an award. Then, the controller executes a race and tallies the result thereof. When a race is determined to be finished, the controller provides an award in accordance with the bet amount of each of the plurality of terminals having qualified for the award, on the basis of a finishing order of the characters in each race.

In a second aspect of the present invention, a gaming system is provided including: a display for displaying images relating to a racing game; a plurality of terminals having an input device for accepting a bet amount for each character that is input by a player in a timer-controlled accepting period, and outputting the accepted bet amount; a first memory for storing a bet amount for each of the terminals that is output by the input device; a second memory for storing a configuration program for setting odds associated with each of the characters; a third memory in which a predetermined proportion can be rewritten on the basis of an access privilege; a controller for executing the racing game, and generating and displaying on the display a moving image in real time regarding progress of a race from beginning to end of the game; and a communication network device allowing intercommunication between the plurality of terminals and the controller, in which the controller executes processing of: (a) receiving a bet amount during a bet accepting period from the input device via the communication interface and storing the bet amount in the first memory, in response to the reception of the bet amount or regularly at predetermined intervals, while calculating the odds for winning of each of the characters by using the configuration program stored in the second memory and displaying the odds calculated on the display; (b) calculating the odds using the configuration program stored in the second memory upon expiration of the bet accepting period, paying back the bet amount to the station having placed a bet on the odds in a case where the odds is not greater than a predetermined threshold stored in the third memory, and excluding the bet for the odds from bets having qualified for an award; and (c) providing an award when a race is determined to be finished, based on a finishing order of the characters, a type of a bet made on each of the plurality of terminals, and an amount of a bet having qualified for the award.

In a third aspect of the present invention, a gaming system is provided including: a display for displaying images relating to a racing game; a plurality of terminals having an input device for accepting a bet amount for each character that is input by a player in a timer-controlled accepting period, and outputting the accepted bet amount; a first memory for storing the bet amount for each of the terminals that is output by the input device; a second memory for storing a configuration program for setting odds associated with each of the characters; a controller for executing the racing game, and generating and displaying on the display a moving image in real time regarding progress of a race from beginning to end of the game; and a communication network device allowing intercommunication between the plurality of terminals and the controller, in which the controller executes processing of: (a) receiving bet amount in a bet accepting period from the input device via the communication interface and storing the bet amount in the first memory, while, in response to the reception of the bet amount or regularly at predetermined intervals, calculating the odds for winning of the each character by using the configuration program stored in the second memory, preventing odds being not greater than a first threshold from being displayed on the display, and displaying the other odds on the display; (b) calculating the odds using the configuration program stored in the second memory at expiration of the bet accepting period, paying back the bet amount to the station having placed a bet on the odds in a case where the odds is not greater than a second threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

In a fourth aspect of the present invention, a gaming system is provided including: a display for displaying images relating to a racing game; a plurality of terminals having an input device for accepting bet amount for each character that is input by a player in a timer-controlled accepting period, and outputting the accepted bet amount; a first memory for storing a value obtained by subtracting from a bet amount a predetermined proportion thereof, the bet amount is specified by each of the terminals and is output by the input device; a second memory for storing a configuration program for setting odds associated with the each character; a fourth memory for storing the predetermined proportion of the bet amount; a controller for executing the racing game, and generating and displaying on the display a moving image in real time regarding progress of a race from the beginning to the end of the game; and a communication network device allowing intercommunication between the plurality of terminals and the controller, in which the controller executes steps of: (a) receiving bet amount in a bet accepting period from the input device via the communication interface, storing the value obtained by subtracting from a bet amount the predetermined proportion thereof in the first memory, and storing the predetermined proportion in the fourth memory, while, in response to the reception of the bet amount or regularly at predetermined intervals, calculating the odds for winning of the each character by using the configuration program stored in the second memory and displaying the calculated odds on the display; (b) calculating the odds using the configuration program stored in the second memory at expiration of the bet accepting period, providing credits accumulated in the fourth memory to the station having placed a bet on the odds by a processing randomly making a determination in a case where the odds is not greater than a predetermined threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

In a fifth aspect of the present invention, a gaming system is provided including: a display for displaying images relating to a racing game; a plurality of terminals having an input device for accepting bet amount for each character that is input by a player in a timer-controlled accepting period, and outputting the accepted bet amount; a first memory for storing a value obtained by subtracting from a bet amount a predetermined proportion thereof, the bet amount is specified by each of the terminals and is output by the input device; a second memory for storing a configuration program for setting odds associated with the each character; a fourth memory for storing the predetermined proportion of the bet amount; a controller for executing the racing game, and generating and displaying on the display a moving image in real time regarding progress of a race from the beginning to the end of the game; and a communication network device allowing intercommunication between the plurality of terminals and the controller, in which the controller executes steps of: (a) receiving bet amount in a bet accepting period from the input device via the communication interface, storing the value obtained by subtracting from a bet amount the predetermined proportion thereof in the first memory, and storing the predetermined proportion in the fourth memory, while, in response to the reception of the bet amount or regularly at predetermined intervals, calculating the odds for winning of the each character by using the configuration program stored in the second memory and displaying the calculated odds on the display; (b) providing credits by any one of the following steps of: calculating the odds using the configuration program stored in the second memory at expiration of the bet accepting period, providing credits equivalent to the bet amount or to a predetermined proportion of the bet amount to the station having placed a bet on the odds in a case where the odds is not greater than a predetermined threshold; providing credits of which amount is obtained by multiplying the bet amount by a value randomly selected from a predetermined range; providing credits accumulated in the fourth memory by a random determination; and providing credits for a jackpot award having at least 2 stages with different values by a random determination, and eliminating the bet for the odds from bets being qualified for an award, and (c) providing an award to a station that is qualified therefor, when a race is determined to be finished, on the basis of the bet amount and the odds.

In a sixth aspect of the present invention, a gaming method is provided, in which a controller having: a display for displaying images relating to a racing game; a plurality of terminals having an input device for accepting bet amount for each character that is input by a player in a timer-controlled accepting period, and outputting the accepted bet amount; a first memory for storing bet amount for each of the terminals that is output by the input device; a second memory for storing a configuration program for setting odds associated with the each character; a controller for executing the racing game, and generating and displaying on the display a moving image in real time regarding progress of a race from the beginning to the end of the game; and a communication network device allowing intercommunication between the plurality of terminals and the controller, executes steps of: (a) receiving bet amount in a bet accepting period from the input device via the communication interface and storing the bet amount in the first memory, while, in response to the reception of the bet amount or regularly at predetermined intervals, calculating the odds for winning of the each character by using the configuration program stored in the second memory and displaying the calculated odds on the display; (b) calculating the odds using the configuration program stored in the second memory at expiration of the bet accepting period, paying back the bet amount to the station having placed a bet on the odds in a case where the odds is not greater than a predetermined threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

DETAILED DESCRIPTION OF THE INVENTION

Figure 1:
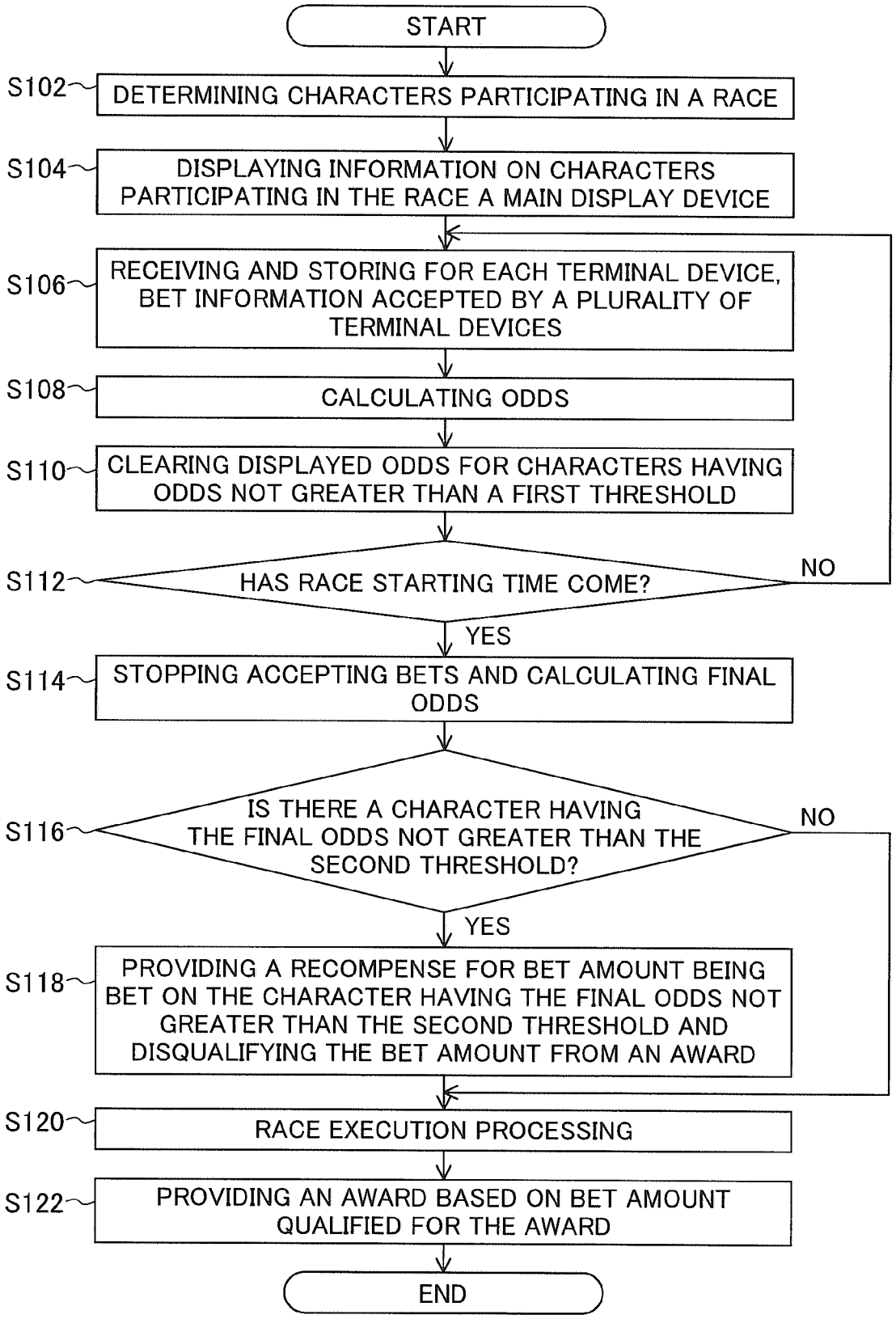
FIG. 1 is a flow chart showing the main part of the present invention.

The main part of the present invention is described hereinafter with reference to FIG. 1. A main control unit 112, of a main controller 20 controlling overall the gaming system 1 according to the present invention, determines characters participating in a race (Step S102). In Step S104, the main control unit 112 displays the characters determined to participate in a race on a main display device 21 and/or a sub display device 34. In Step S106, the main control unit 112 receives from a plurality of terminal devices 30 bet and bet amount accepted thereby, and stores the bet and the bet amount, for each terminal device 30, in a first memory region assigned to a predetermined region in RAM 142. In Step S106, the main control unit 112 can alternatively advances to the following step in response to the reception of bet information from the terminal device, or advances to the following step immediately by referencing a receive buffer and the like that stores the bet information accordingly. In Step S108, the main control unit 112 calculates the odds for winning of each of the characters based on the total amount of bet, using a configuration program stored in a second memory region. In Step S110, the main control unit 112 clears the displayed odds for the character having odds not greater than a predetermined value (a first threshold). In Step S112, the main control unit 112 determines whether it is the time for starting the race or not, using a timer 148. In the case of a YES determination, processing is advanced to Step S114 and in the case of a NO determination, processing is advanced to Step S106. In other words, Steps S106 to S112 are reiterated during the bet accepting period before starting the race.

In Step S114, the main control unit 112 stops accepting bet and calculates final odds. In Step S116, the main control unit 112 determines whether there is a character having the final odds not greater than a predetermined value (a second threshold) or not. YES for this determination leads to Step S118 and NO for this determination leads to Step S120. In Step S118, the main control unit 112 provides a recompense for the bets on the character having the final odds not greater than the second threshold and disqualifies the bet amount from an award. In Step S120, the main control unit 112 executes a racing game, and then advances to Step S122. In Step S122, the main control unit 112 calculates an award for each character based on a result of the racing game, and provides the award to each terminal device 30 based on the bet amount qualified for the award.

Figure 2:
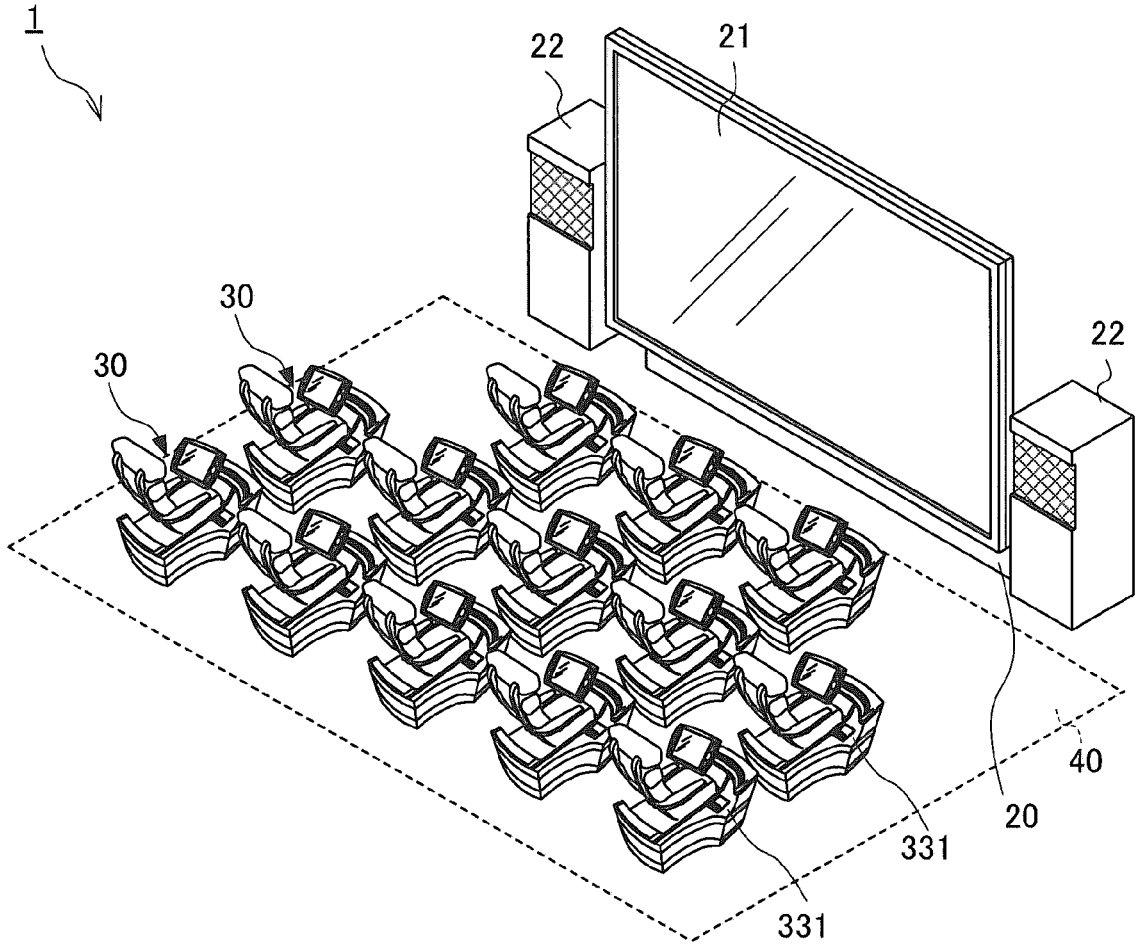
FIG. 2 is a perspective view showing the gaming system according to a preferred embodiment of the present invention.

FIG. 2 is a perspective view showing an appearance of a gaming system 1 including a plurality of terminal devices 30. The gaming system 1 is a multi-player gaming system for a multi-player-type horse racing game, in which a plurality of players can participate, including a plurality of terminal devices 30 and a main controller 20, which is a controller having a large main display device 21.

The main controller 20 includes and controls the main display device 21 and a speaker device 22 installed on both sides of the main display device 21.

The main display device 21 is a large projector display device. The main display device 21 displays an image of a plurality of racehorses racing, a result of a race, and the like, in response to control by the main controller 20. On the other hand, a sub display device included in each terminal device 30 displays odds information for each racehorse, information related to a bet made by the player himself, and the like. It should be noted that, a large projector display device is used in the present embodiment; however, the present invention is not limited thereto and any large monitor can be used.

Figure 3:
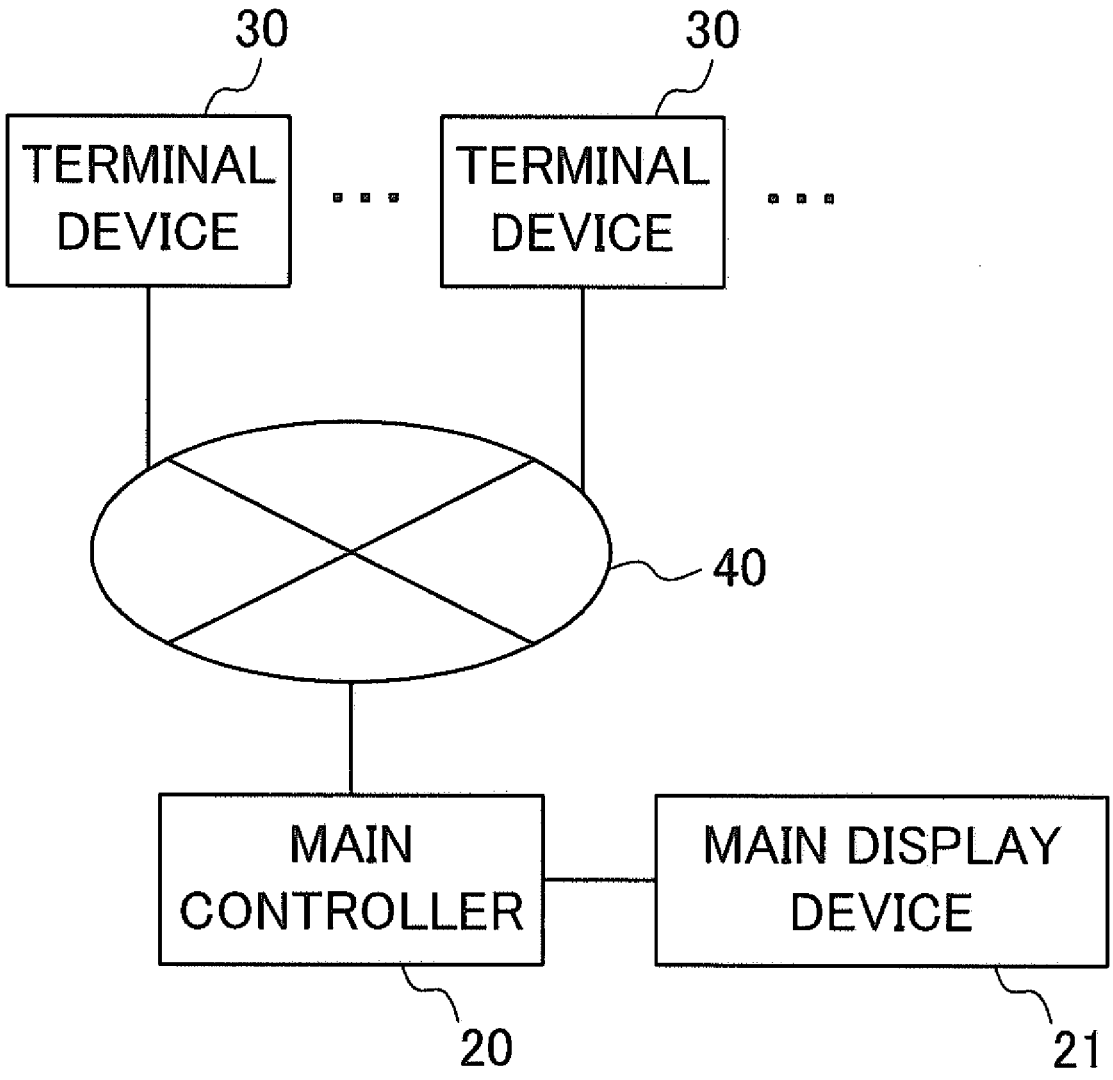
FIG. 3 is a diagram showing the configuration of a gaming system according to a preferred embodiment of the present invention.

FIG. 3 is a schematic diagram showing a network of the gaming system 1.

In the gaming system 1, the main controller 20 and the plurality of terminal devices 30 can communicate with each other via a communication line and form a network 40. The main display device 21 is configured to be controlled from the main controller 20. The communication line can provide a wired or wireless connection.

Figure 4:
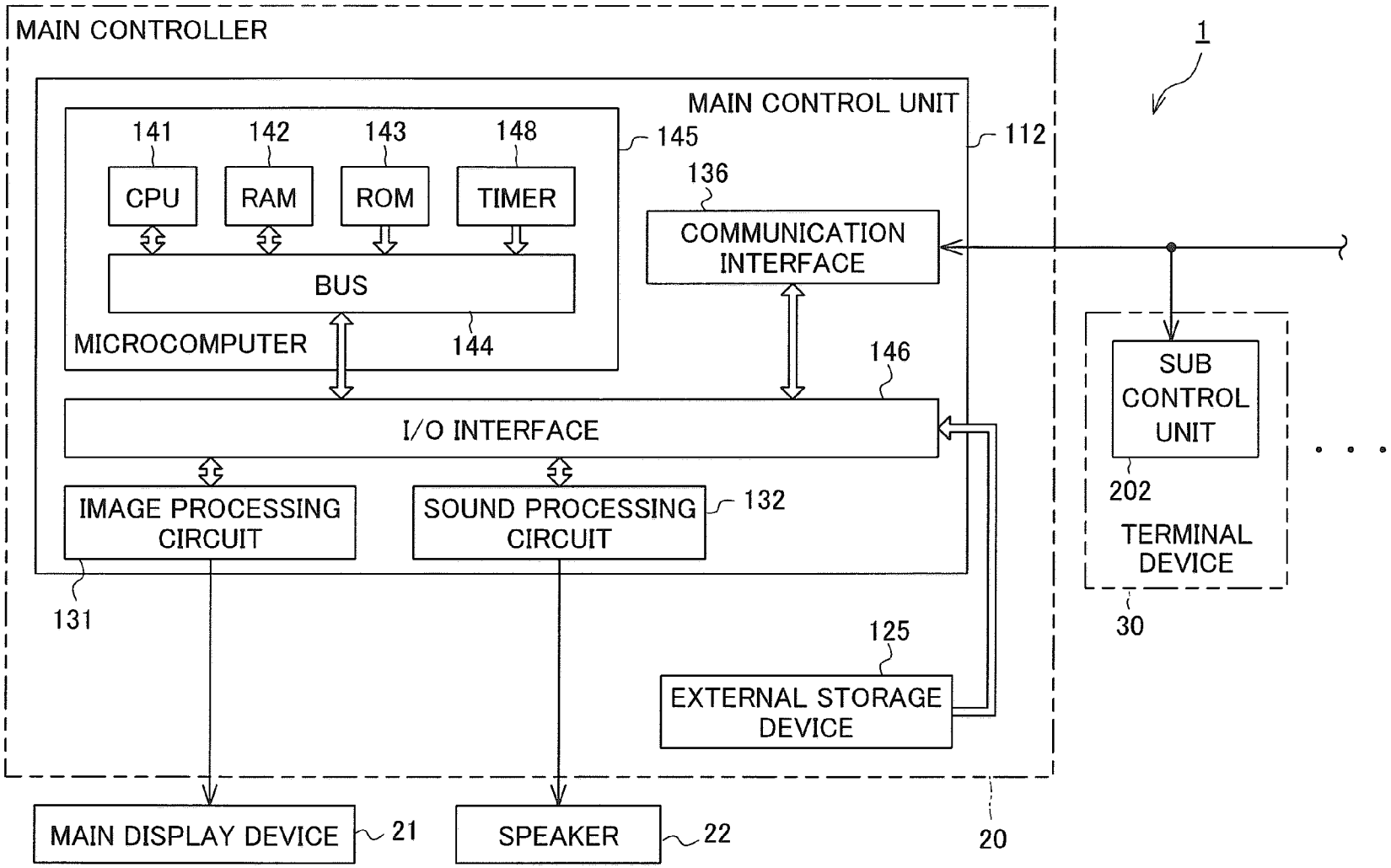
FIG. 4 is a block diagram of a main controller of the gaming system according to a preferred embodiment of the present invention.

FIG. 4 is a block diagram showing the configuration of a main control unit 112 included in the main controller 20. Basically, the main control unit 112 is constituted mainly of a microcomputer 145 constituted of a CPU 141, RAM 142, ROM 143, a timer 148, and a bus 144 for data transfer therebetween. The RAM 142, the ROM 143, and the timer 148 are connected to the CPU 141 via the bus 144. The RAM 142 is memory for temporarily storing various data computed by the CPU 141. The ROM 143 stores various programs for processings required for the control of the gaming machine 1, data tables, and the like. In the RAM 142, a memory region is assigned to each program and data, to allocate a first memory region for storing bet amount, a second memory region for storing the configuration program, a third memory region that is writable based on an access privilege, a fourth memory region for accumulating credits for a jackpot, and the like. The timer 148 is a digital clock that can operate independently. The CPU 141 can obtain the current time and/or the time elapsed therefrom, in the format of string or the like that can be processed by computer.

An image processing circuit 131 is connected to the microcomputer 145 via an I/O interface 146. The image processing circuit 131 is connected to the main display device 21 and controls the operation thereof.

The image processing circuit 131 is constituted of: program ROM; image ROM; an image control CPU; work RAM; a video display processor (VDP); video RAM; and the like. The program ROM stores an image control program and various selection tables related to the display on the main display device 21. The image ROM stores dot data for forming an image, such as dot data for forming an image on the main display device 21. The image control CPU determines an image to be displayed on the main display device 21 from dot data prestored in the image ROM based on a parameter defined by the microcomputer 145 and in accordance with an image control program prestored in the program ROM. The work RAM functions as a temporary storage device for executing the image control program by the image control CPU. The VDP generates image data according to the display content determined by the image control CPU, and outputs the same to the main display device 21. The video RAM functions as a temporary storage device to be used for forming an image by the VDP.

A sound processing circuit 132 is connected to the microcomputer 145 via the I/O interface 146. A speaker device 22 is connected to the sound processing circuit 132. The speaker device 22 generates various sound effects, BGM and the like for implementing various effects, based on a driving signal from the CPU 141 and with an output control by the sound processing circuit 132.

An external storage device 125 is connected to the microcomputer 145 via the I/O interface 146. The external storage device 125 operates similarly to the image ROM in the image processing circuit 131, in a case in which dot data for forming an image, such as dot data for forming an image on the main display device 21, is stored therein. Therefore, the image control CPU in the image processing circuit 131 selects an image to be displayed on the main display device 21 also from dot data prestored in the external storage device 125.

A communication interface 136 is connected to the microcomputer 145 via the I/O interface 146. A sub control unit 202 of each terminal device 30 is connected to the communication interface 136. This allows two-way communication between the CPU 141 and each terminal device 30. The CPU 141 can transmit/receive instructions, requests, data and the like with respect to each terminal device 30 via the communication interface 136. Therefore, the main controller 20 of the gaming system 1 controls the progress of a horse racing game, in cooperation with each terminal device 30.

Figure 5:
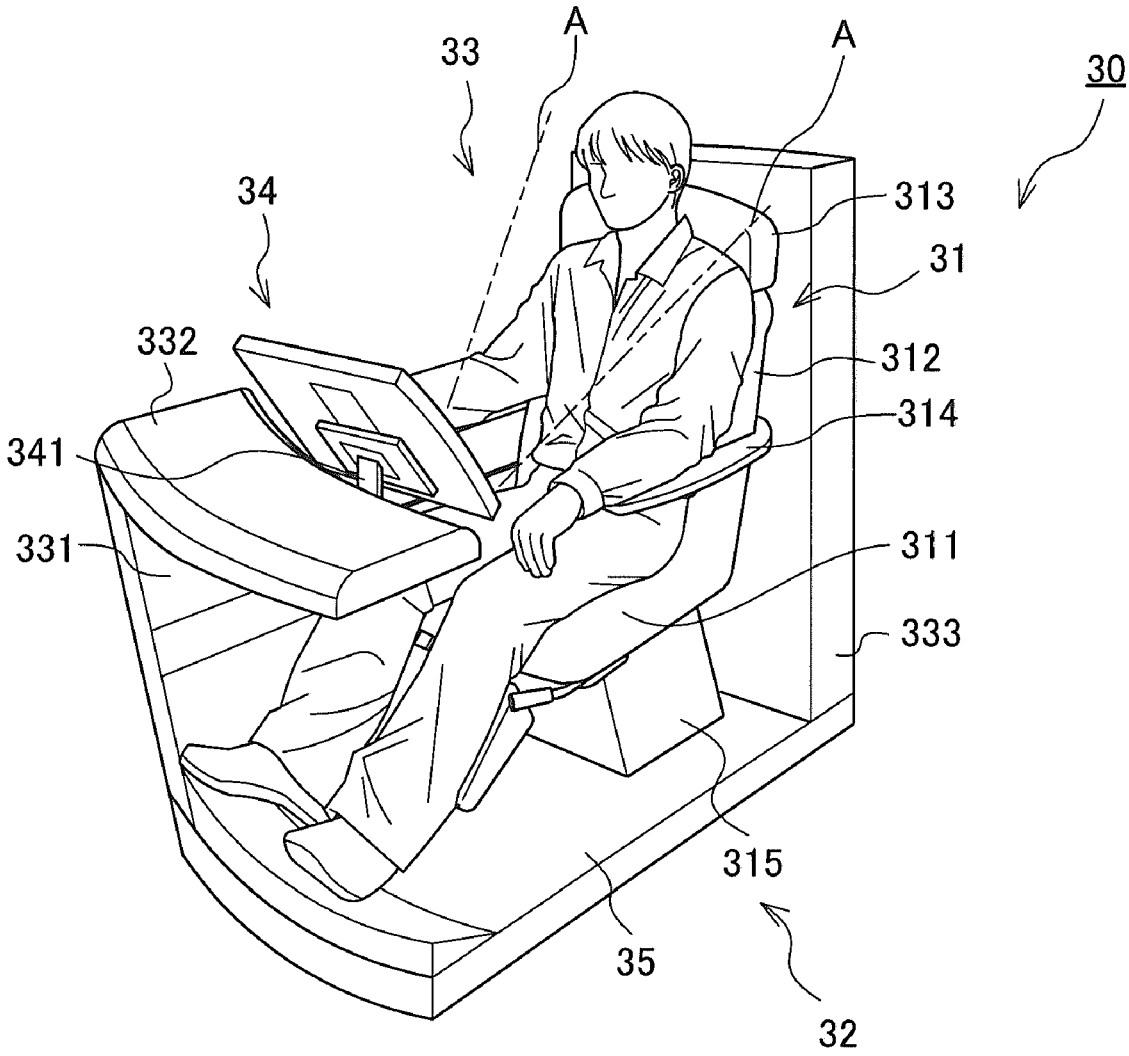
FIG. 5 is a perspective view illustrating the terminal device according to the preferred embodiment of the present invention.

FIG. 5 is a perspective view showing an appearance of each terminal device 30. The terminal device 30 includes: a seat 31 on which a player can sit; an opening 32 formed on one of four lateral faces of the terminal device 30; a seat encircling portion 33 that covers three of four lateral faces of the terminal device 30 except for the lateral face having the opening 32; and a sub display device 34 installed on the seat encircling portion 33, in the front portion of the terminal device 30, that displays images related to the game.

The seat 31 includes: a seating surface 311 on which a player sits; a backrest 312 supporting the back of a player; a headrest 313 installed on top of the backrest 312; armrests 314 installed on both sides of the backrest 312; and a leg 315 fixed to the base portion 35.

The seat encircling portion 33 includes: a side unit 331 installed on an opposite face to the lateral face having the opening 32; a front unit 332 installed in the front portion of the terminal device 30; and a back unit 333 installed in the rear portion of the terminal device 30. This allows a player to sit on and get out of the seat 31 through the opening 32, in which the seat encircling portion 33 is not formed.

A medal slot to which medals corresponding to credits are inserted, a medal payout opening that pays out medals corresponding to credits, and the like are installed on the side unit 331 (not shown). It should be noted that, the gaming medium used in the present embodiment is medals; however, the present invention is not limited thereto. Examples of the gaming medium include coins, tokens, electronic money, or any equivalent valuable information such as electronic credit. In this case, credit can be paid out by a ticket printed out from a ticket printer 216 (described later).

The front unit 332 is a table having the base portion 35 and a substantially horizontal top board, which is movably supported on the side unit 331, in the front portion of the terminal device 30. A player sitting on the seat 31 can put his legs into a room under the front unit 332.

The back unit 333 is integrated with the side unit 331 and constitutes a part of the seat encircling portion 33.

The sub display device 34 includes a supporting arm 341 supported by the front unit 332 and a rectangular liquid crystal monitor 342 for displaying, fixed at the distal end of the supporting arm 341. The liquid crystal monitor 342 is a so-called touch panel, and provided at a position facing the chest of a player sitting on the seat 31. The liquid crystal monitor 342, which is a touch panel, serves as an input device used by a player to bet.

Figure 6:
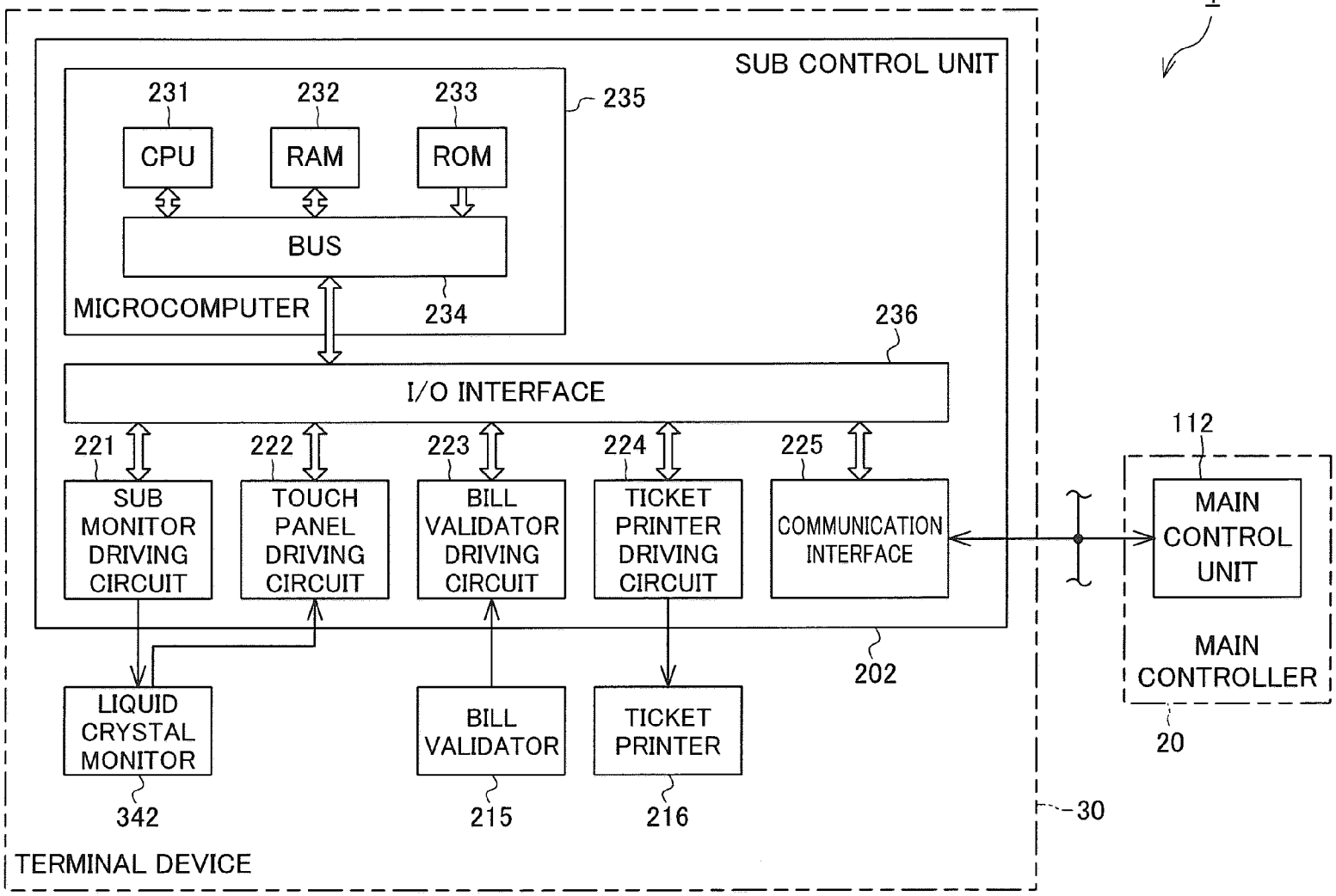
FIG. 6 is a block diagram showing an outline of the terminal device according to a preferred embodiment of the present invention.

FIG. 6 is a block diagram showing the configuration of a sub control unit 202 included in the terminal device 30. The sub control unit 202 controls the terminal device 30 and basically is constituted mainly of a microcomputer 235 constituted of a CPU 231, RAM 232, ROM 233, and a bus 234 for data transfer therebetween. The RAM 232 and the ROM 233 are connected to the CPU 231 via the bus 234. The RAM 232 is memory for temporarily storing various data computed by the CPU 231. The ROM 233 stores various programs for processings required for the control of the gaming system 1, data tables, and the like.

A sub monitor driving circuit 221 is connected to the microcomputer 235 via the I/O interface 236. A liquid crystal monitor 342 is connected to the sub monitor driving circuit 221. The sub monitor driving circuit 221 controls the operation of the liquid crystal monitor 342 based on a driving signal from the main controller 20.

A touch panel driving circuit 222 is connected to the microcomputer 235 via the I/O interface 236. A liquid crystal monitor 342 being a touch panel is connected to the touch panel driving circuit 222. An instruction, by a touching operation by a user, to the surface of the liquid crystal monitor 342 (touched position) is input to the CPU 231 based on a coordinate signal from the touch panel driving circuit 222.

A bill validator driving circuit 223 is connected to the microcomputer 235 via the I/O interface 236. A bill validator 215 is connected to the bill validator driving circuit 223. The bill validator 215 determines whether a bill or a bar coded ticket is valid or not. Upon reception of a valid bill, the bill validator 215 inputs the value thereof to the CPU 231 based upon the validating signal from the bill validator driving circuit 223. In addition, upon reception of a valid bar coded ticket, the bill validator 215 inputs the amount of credit and the like recorded therein to the CPU 231 based upon the validating signal from the bill validator driving circuit 223.

A ticket printer driving circuit 224 is connected to the microcomputer 235 via the I/O interface 146. A ticket printer 216 is connected to the ticket printer driving circuit 224. With an output control by the ticket printer driving circuit 224 based on a driving signal output from the CPU 231, the ticket printer 216 prints a bar code on a ticket, in which the data such as credit amount stored in the RAM 232 are coded, and then prints out a bar coded ticket.

The communication interface 225 is connected to the microcomputer 235 via the I/O interface 236. The main control unit 112 of the main controller 20 is connected to the communication interface 225. This allows two-way communication between the CPU 231 and the main control unit 112. The CPU 231 can transmit/receive instructions, requests, data and the like with respect to the main control unit 112 via the communication interface 225. Therefore, each terminal device 30 of the gaming system 1 controls the progress of a horse racing game, in cooperation with the main controller 20.

Figure 7:
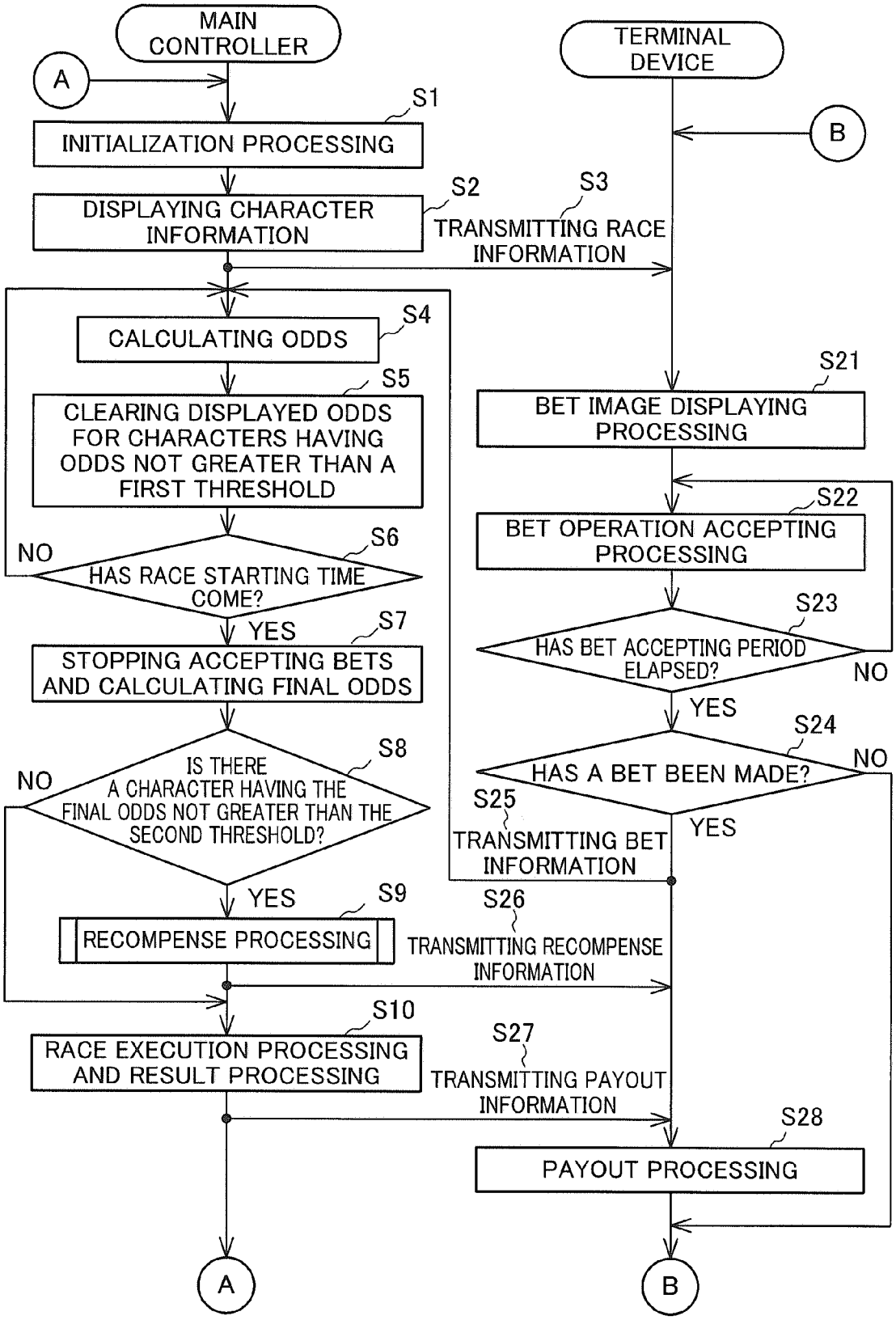
FIG. 7 is a diagram showing the main flow chart of a gaming system according to a preferred embodiment of the present invention.

A flow of the operation of the gaming system 1 will be explained hereinafter with reference to the flow chart shown in FIG. 7. It should be noted that, all the terminal devices 30 similarly perform a game in cooperation with the main controller 20, although a single terminal device 30 is illustrated in FIG. 7.

The main controller 20 processes Steps S1 to S10. Firstly, in Step S, the main control unit 112 performs an initialization processing, then the flow proceeds to Step S2. In this processing, the CPU 141 determines a course of a race, characters participating the race, starting time and the like of the horse racing game, and reads data thereof from the ROM 143.

In Step S2, the main control unit 112 displays the characters determined to participate in the race on a main display device 21.

In Step S3, the main control unit 112 transmits race information to each of the terminal devices 30, then the flow proceeds to Step S4. In this processing, the CPU 141 transmits a course of the race, characters participating the race, bet target team, starting time and the like, to each terminal device 30.

In Step S4, the main control unit 112 calculates the odds using the configuration program stored in the second memory region.

In Step S5, the main control unit 112 clears the displayed odds for the character having odds not greater than the first threshold. The first threshold is used for clearing the odds, to avoid the risk due to bets concentrated on a specific character. This can inhibit an increased risk due to a large number of bets made on the popular character at the last minute. The first threshold can be a predetermined numerical value such as 2 times, 1.5 times and the like, or can be determined arbitrarily by a casino owner and stored in the third memory region allocated in the RAM 142 that is writable based on an access privilege. Users and programs without the access privilege cannot change the third memory region. The validity of the first threshold can be thus maintained during operation of the gaming system of the present invention, by using the third memory region.

In Step S6, the main control unit 112 determines whether it is the time for starting the race. In the case of a YES determination, processing is advanced to Step S7 and in the case of a NO determination, processing is advanced to Step S4. More specifically, the CPU 141 repeatedly checks the clock time until the time for starting the race comes, and, at the time for starting the race, advances the flow to Step S7.

In Step S7, the main control unit 112 stops accepting the bets, calculates the final odds using the configuration program stored in the second memory region, and advances to Step S8.

In Step S8, the main control unit 112 determines whether there is a character having the final odds not greater than the second threshold or not. In the case of a YES determination, processing is advanced to Step S9 and in the case of a NO determination, processing is advanced to Step S10. The second threshold is used for providing a recompense to the players. The second threshold can be either the same as or different to the first threshold. The second threshold can be a predetermined numerical value such as 1.1 times, 1.0 times and the like, or can be determined arbitrarily by a casino owner and stored in the third memory region. The validity of the second threshold can be thus maintained during operation of the gaming system of the present invention, by using the third memory region.

In Step S9, the main control unit 112 qualifies the bet number on a character having odds not greater than the second threshold for the recompense processing of the gaming system of the present invention, and disqualifies the bet amount from an award provided on the basis of the result of the race. Details will be described later. After Step S9, the main control unit 112 advances to Step S26.

In Step S10, the main control unit 112 executes a race and displays a result thereof. More specifically, the CPU 141 displays a race image on the main display device 21 and outputs sound effects and voice from the speaker device 22, based on data that is read from the ROM 143 in Step S1. In addition, the CPU 141 calculates payout amount for each terminal device 30 on the basis of finishing order of the characters having participated in the race and data regarding the bet information received from the each terminal device 30.

On the other hand, each terminal device 30 processes Steps S21 to S28. Firstly, in Step S21, the sub control unit 202 performs a bet image display processing, then the flow proceeds to Step S22. In this processing, the CPU 231 displays the odds for each racehorse, past records thereof and the like on the liquid crystal monitor 342, based on the data sent from the main controller 20 in Step S3.

In Step S22, the sub control unit 202 performs a bet operation accepting processing, then the flow proceeds to Step S23. In this processing, the CPU 231 enables touch operation by a player on the surface of the liquid crystal monitor 342 being a touch panel, starts accepting bet operation by the player, and changes images displayed thereon in accordance with the bet operation.

In Step S23, the sub control unit 202 determines whether a bet accepting period has elapsed or not. YES for this determination leads to Step S24 and NO for this determination leads to Step S22. More specifically, the CPU 231 repeatedly checks the clock time, preferably using the timer 148 embedded in the main control unit 112, until a predetermined period is expired since the bet operation accepting processing is started in Step S22, and, once the predetermined period has elapsed, stop accepting the bet operation by the player and advances the flow to Step S24.

In Step S24, the sub control unit 202 determines whether a bet operation has been performed or not. YES for this determination leads to Step S25 and NO for this determination leads to Step S21. In this processing, the CPU 231 determines whether a bet operation has been performed in the abovementioned period in which the bet operation has been accepted.

In Step S25, the sub control unit 202 performs a bet information transmission processing. In this processing, the CPU 231 transmits data regarding the performed bet operation to the main controller 20. After receiving data regarding bet operation from a plurality of terminal device 30, the main controller 20 stores each data, for each terminal device 30, in the first memory region allocated in RAM 142.

In Step S26, the main control unit 112 transmits recompense information to the terminal devices 30 qualified for the recompense processing. In other words, only the terminal devices 30 qualified for the recompense processing receive the recompense information.

In Step S27, the main control unit 112 submits payout information to the sub control unit 202.

In Step S28, the sub control unit 202 performs a payout processing, then the flow proceeds to Step S21. In this processing, the CPU 231 pays out medals from the medal payout opening, based on the data regarding payout sent from the main controller 20 in Step S26 and/or the data regarding the recompense sent from the main controller 20 in Step S27 and the like. In other words, the processing performed on the terminal device 30 is repeated for each race in the main controller 20.

Figure 8:
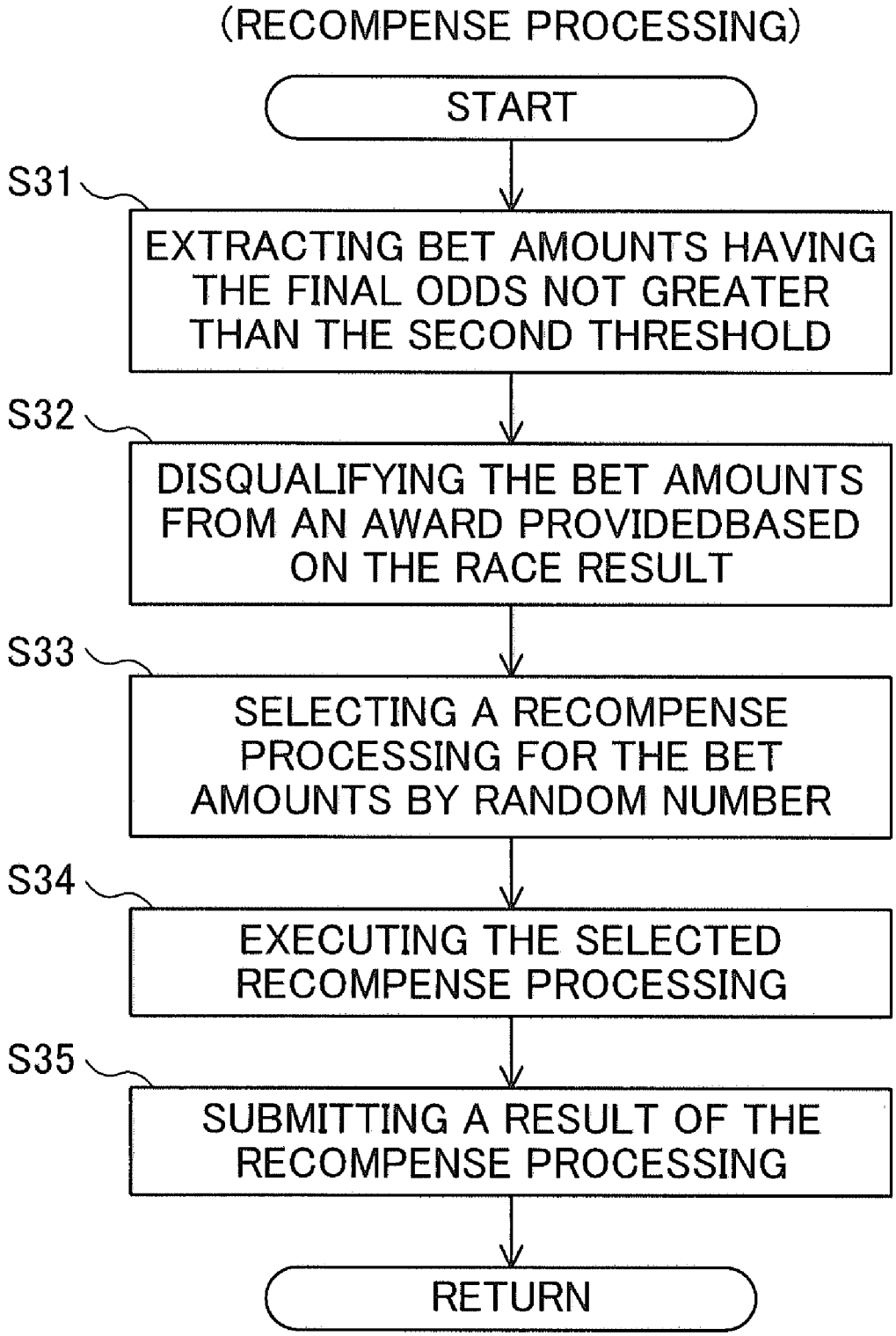
FIG. 8 is a diagram showing a selection of recompense processing according to the preferred embodiment of the present invention.

The recompense processing by the main control unit 112 is described with reference to FIG. 8.

In Step S31, the main control unit 112 extracts the bets having the final odds not greater than the second threshold. More specifically, in a case where there is a character having the final odds not greater than the second threshold as a result of the determination in Step 8, the main control unit 112 obtains information such as the number of terminal devices having placed a bet on the final odds, bet amount thereof, total bet amount thereof and the like.

In Step S32, the main control unit 112 disqualifies the bet amount, qualified for the recompense processing, from an award provided on the basis of the result of the race. More specifically, the main control unit 112 subtracts, by the CPU 141, the bet amount qualified for the recompense processing from the total bet amount for providing an award.

In Step S33, the main control unit 112 selects the recompense processing for the bet amount qualified therefor, by using random numbers. More specifically, the recompense processing is selected from: providing credit equivalent to the bet amount or to a predetermined proportion of the bet amount; providing credit equivalent to a value obtained by multiplying the bet amount by a value randomly selected from a predetermined range; providing accumulated credit by a random determination; and providing credit of a jackpot award, with at least 2 stages with different value, by a random determination. The processing of providing accumulated credit by a random determination can be a progressive jackpot. Credit for the progressive jackpot can be accumulated by allocating a fourth memory region in the RAM 142 of the main control unit 112.

In Step S34, the main control unit 112 performs the recompense processing selected in Step S33. The main control unit 112 thus calculates the value of the credit for the recompense, which is related to the bet amount qualified for the recompense processing.

In Step S35, the main control unit 112 submits information regarding the credit for the recompense, calculated above, to the terminal device 30 qualified for the recompense processing.

A display example of the bet window shown on the liquid crystal monitor 342 of the terminal device 30 will be hereinafter described with reference to FIG. 9. With the display example, a player can arbitrarily select from Quinella (to predict a combination of characters in first and second places), Win (to predict a character winning first place), Place (to predict a character finishing in any one of first to third places) and the like, and can bet credit on an intended character or on an intended combination of characters by looking at displayed bets. A case where a player bets to Win is described hereinafter as an example.

The liquid crystal monitor 342 can be used as a touch panel, thus allowing a player to perform a bet operation by touching the touch panel according to the display thereon. In other words, the liquid crystal monitor and the touch panel is an input device of the terminal device 30.

Figure 9:
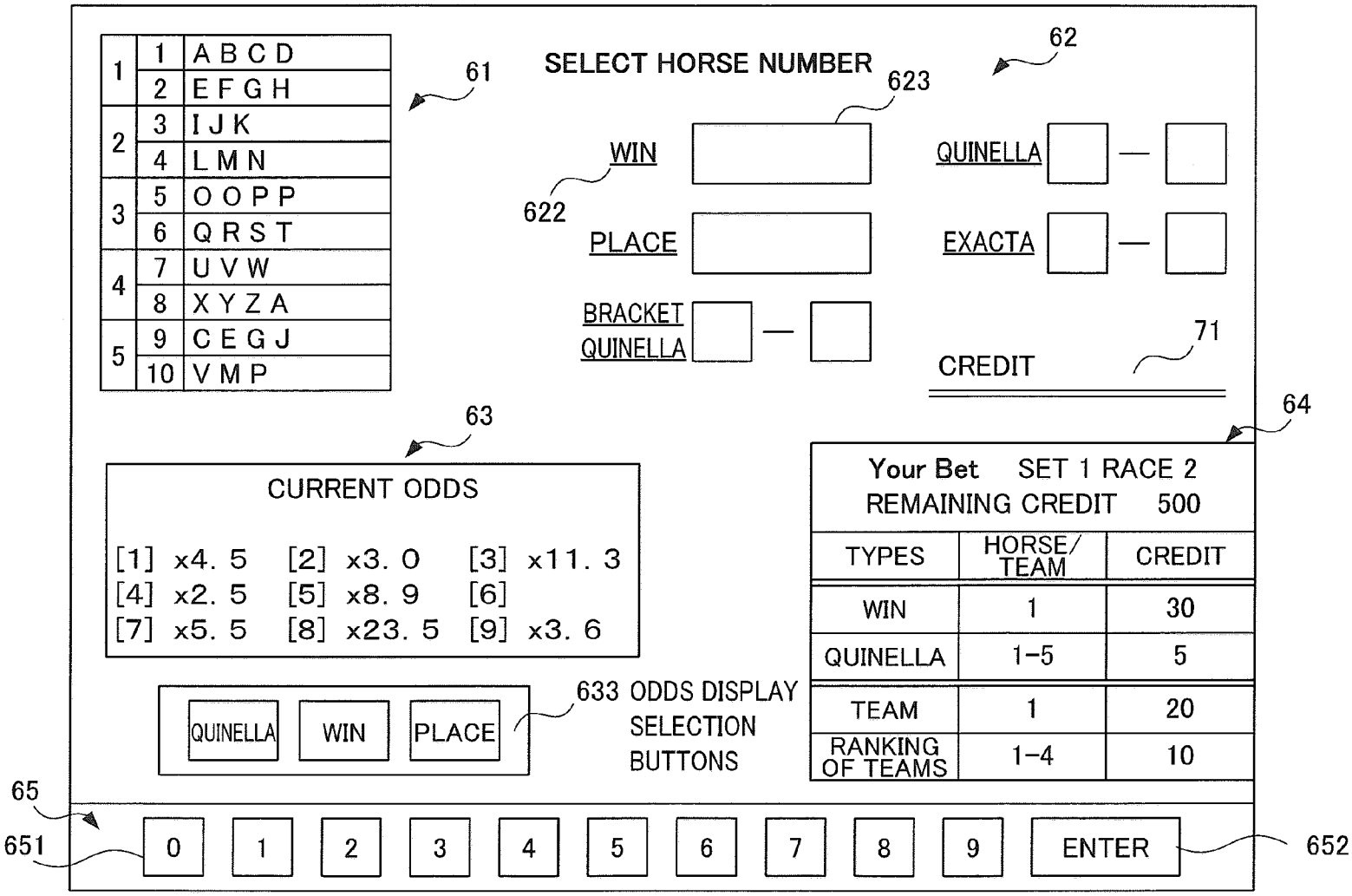
FIG. 9 is a diagram showing a display example of the sub display device of the terminal device according to a preferred embodiment of the present invention.

The bet window is divided into 5 areas in the display example of FIG. 9. The first area 61 displays the character number, the post position, the character name and the like of the characters participating the race. A player can select the character to bet on with reference thereto.

The second area 62 is an area for betting. An input area is provided for each bet type that can be chosen in the racing game. The bet types can include any bet type that can be chosen in the normal horse racing games, such as Win and Quinella. To input, a player touches a bet type to make the bet type be in a selected state. Subsequently, a player touches a character number or a character name displayed on the first area 61 to bet thereon. For example, to make a Win bet, a player firstly touches an item 622 "Win", then touches a character number or a character name displayed on the first area. This inputs the character number touched by a player in a column 622.

The third area 63 is an area for displaying odds during the bet accepting period. The player can check information regarding current odds for each race horse, by arbitrarily selecting any one of odds display selection buttons 633 provided in the area 63. For example, in a case where the player touches a button "Win" of the odds display selection buttons 633, the area 63 displays a list of current odds for Win. The same holds for Quinella, Place and the like.

The fourth area 64 displays a list of bets made by a player. A player can check the number of races finished, the bets he made, the remaining credit and the like, by looking at the fourth area 64.

The fifth area 65 is the numerical pad area. A player inputs bet amount in the fifth area 65. A player can input a bet amount by touching a stake input area 711, then each number key 651 displayed in a numerical pad area 65. A player can confirm the input numerical value by touching an input key 652.

A display example of the main display device 21 will be described with reference to FIGS. 10 to 12.

Figure 10:
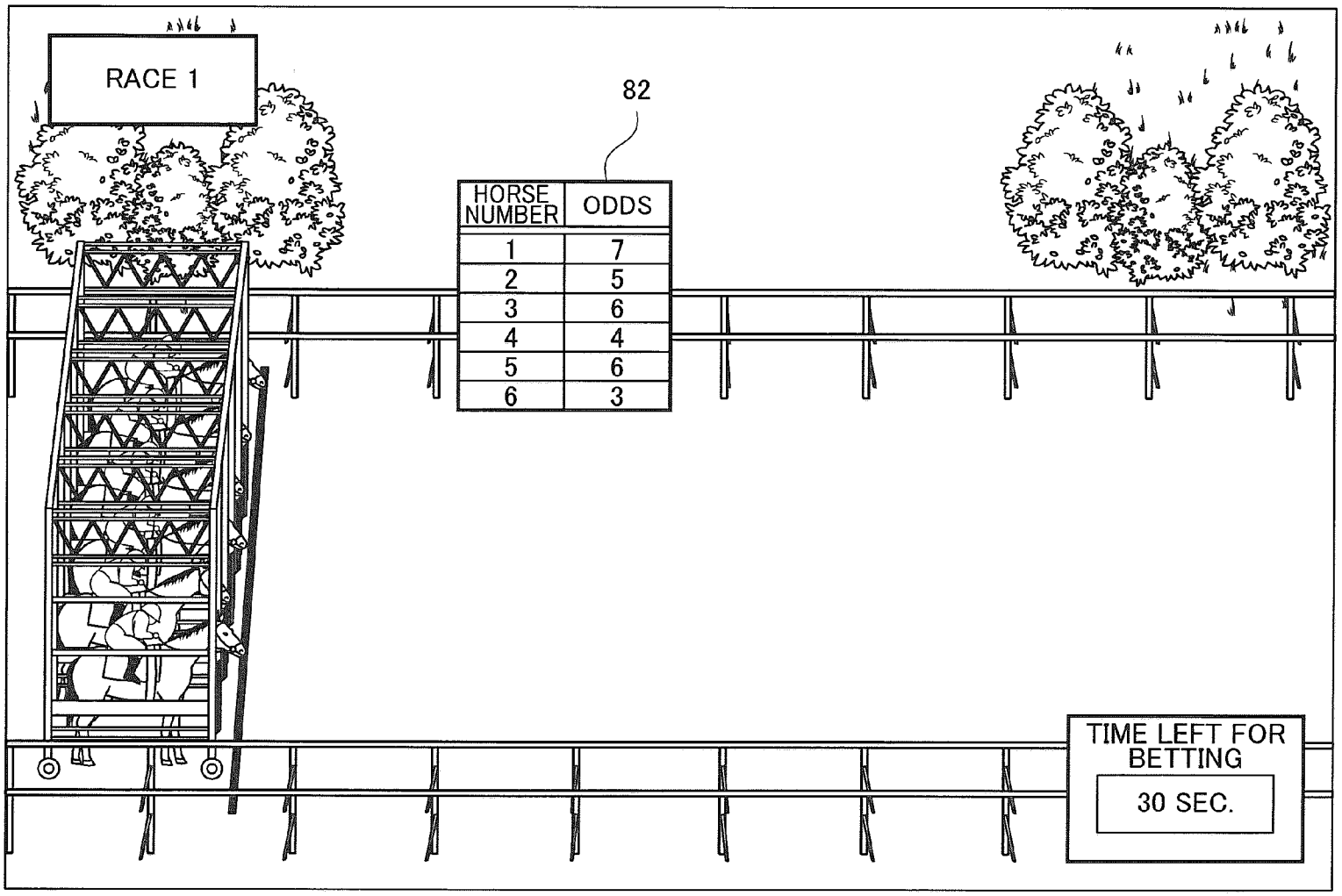
FIG. 10 is a diagram showing a display example of the main display device according to a preferred embodiment of the present invention.

FIG. 10 is a display example in the bet accepting period, before starting of a race. According to FIG. 10, the main display device 21 displays characters being target of bet, odds 82 for each horse number and the like. The displayed contents can be arbitrarily designed. The characters participating in the race can be identified by character numbers and the like.

Figure 11:
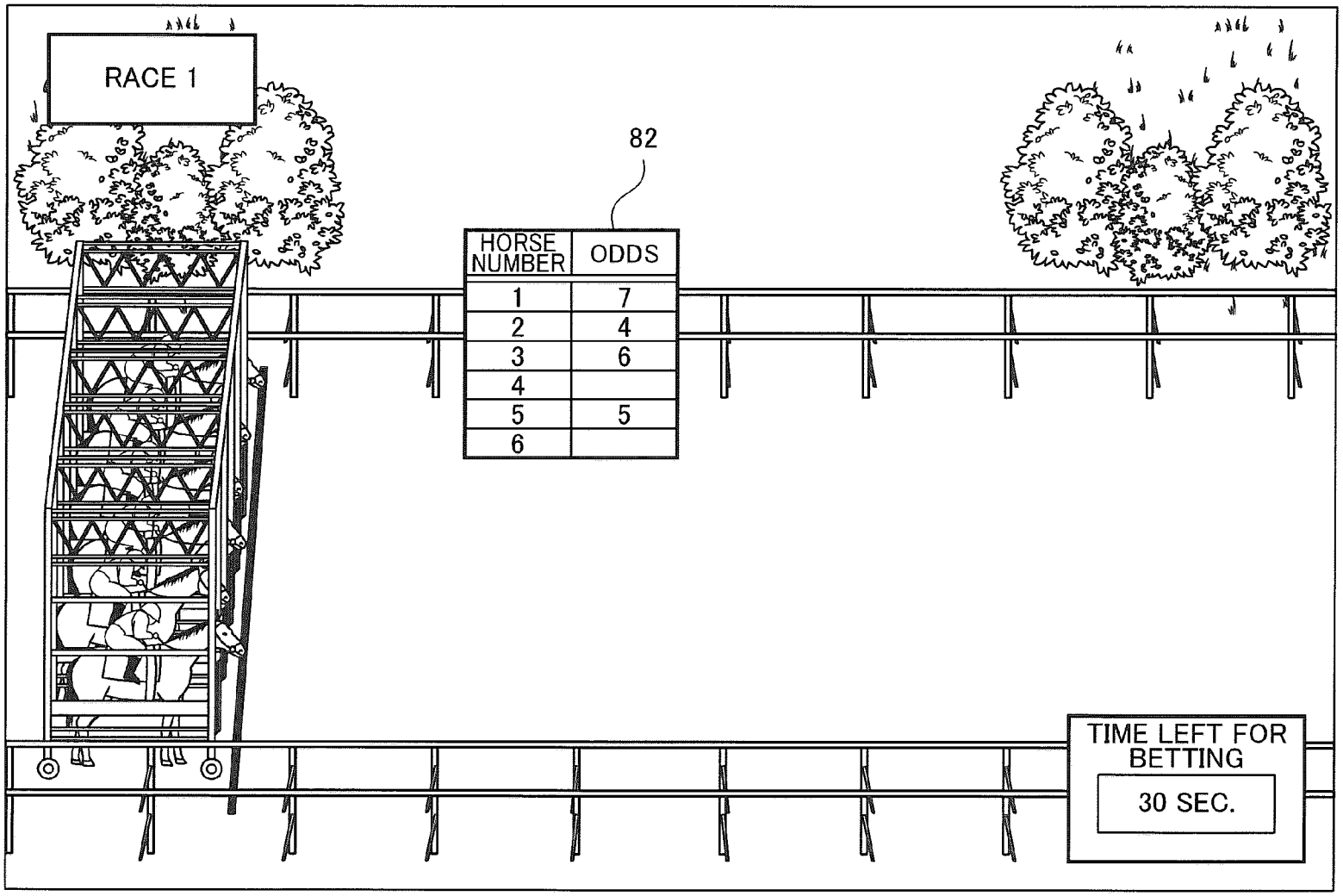
FIG. 11 is a diagram showing a display example of the main display device according to a preferred embodiment of the present invention.

FIG. 11 is another display example in the bet accepting period, before starting of a race. A case where the odds for the horse number 6 lowers due to an increased bets thereon is described hereinafter. In a case where the odds is not greater than the first threshold, the main control unit 112 of the gaming system of the present invention clears the displayed odds for the horse number 6. Therefore, the player cannot be sure about an award provided when the horse number 6 wins. This may provide the following two effects.

First, the gaming system of the present invention can delete information triggering a large number of bets concentrated on a specific popular character, which is likely to win, at the last minute, by clearing information regarding the low odds from the displayed odds 82.

Next, by clearing the information regarding low odds, an opportunity to predict a character having a large number of bets is provided to players. This can give a player an opportunity to predict the kind of recompense processing, and, give a player, who has already made a bet, an expectation that a jackpot may occur for the character he has bet on.

The gaming system of the present invention thus provides the recompense processing for risk of no profit, and increases an expectation for the recompense processing that is randomly selected.

Figure 12:
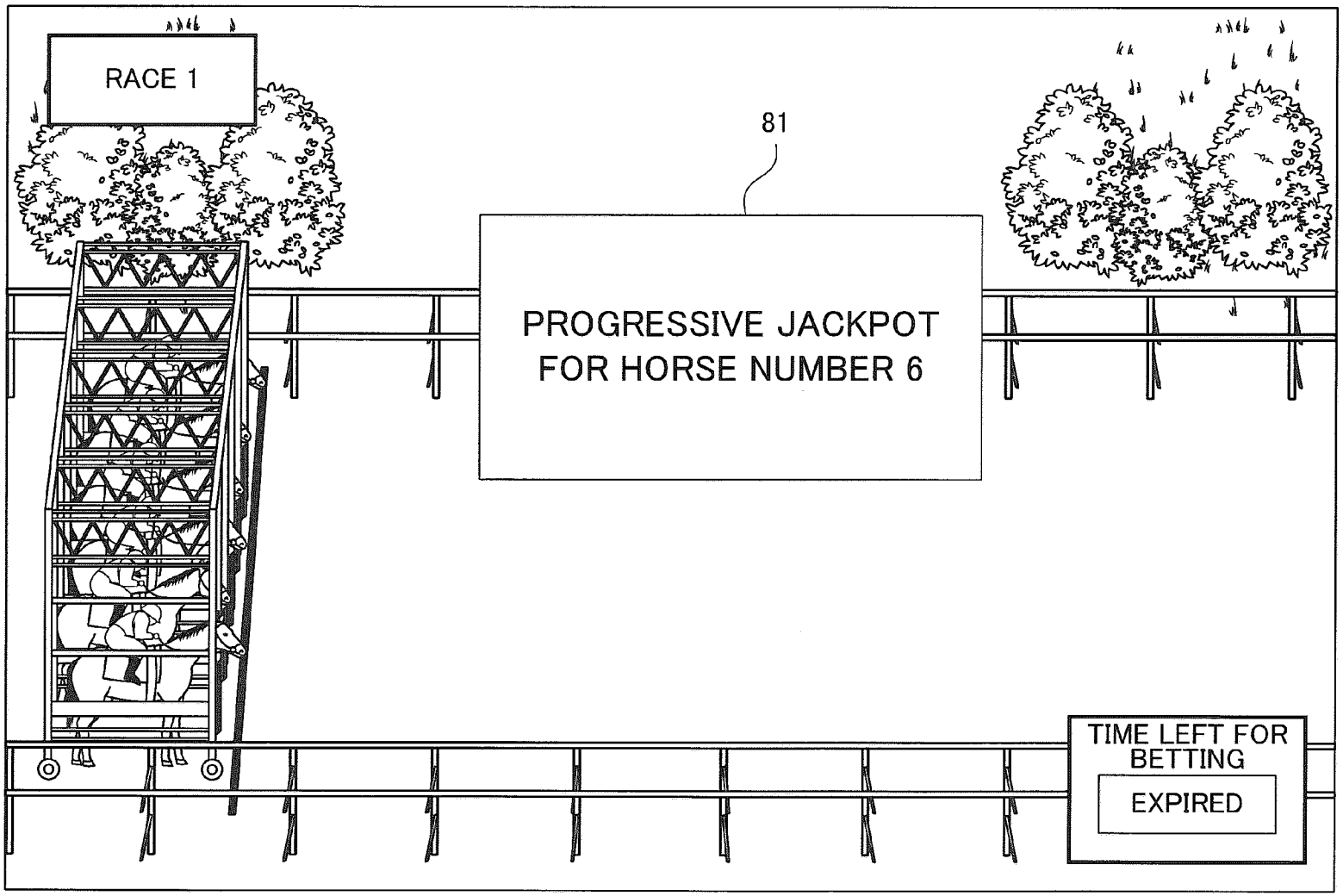
FIG. 12 is a diagram showing a display example of the main display device according to a preferred embodiment of the present invention.

FIG. 12 is a display example at the expiration of the bet accepting period before starting a race. At the expiration of the bet accepting period, the main control unit 112 determines whether there are odds lower than the second threshold. In the case of YES determination, the main control unit 112 executes the recompense processing randomly selected. For example, in a case where no profit will be given for the horse number 6, the main control unit 112 randomly selects and executes the recompense processing such as the progressive jackpot. The main control unit 112 may notify this status to players by means of a recompense processing display 81 and the like.

Thus, the gaming system of the present invention can provide a gaming system, a gaming machine and a game control method with various bet types and a higher chance of being rewarded, thus arousing interest and excitement of the player.

A recompense processing based on the horse number in a Win bet has been described the present embodiment; however, the recompense processing can also be applied to Quinella, Place and the like by setting the first and the second threshold.

It should be noted that, the gaming medium used in the present embodiment is medals; however, the present invention are not limited thereto. Examples of the gaming medium include coins, tokens, electronic money, or any equivalent valuable information such as electronic credit.

While the preferred embodiment of the present invention have been described above, it will be apparent to one skilled in the art that various changes and modifications can be made without departing from the amended claims.

What is claimed is:

1. A gaming system comprising:

a display for displaying images relating to a racing game;

a plurality of terminals having an input device for accepting bet amount for each character that is input by a player within a timer-controlled accepting period, and outputting the accepted bet amount;

a first memory for storing the bet amount for each of the terminals that is output by the input device;

a second memory for storing a configuration program for setting odds associated with the each character;

a controller for executing the racing game, and generating and displaying on the display a moving image in real time regarding progress of a race from the beginning to the end of the game; and a communication network device allowing intercommunication between the plurality of terminals and the controller, wherein the controller executes processing of:

(a) receiving bet amount in a bet accepting period from the input device via the communication interface and storing the bet amount in the first memory, while, in response to the reception of the bet amount or regularly at predetermined intervals, calculating the odds for winning of the each character by using the configuration program stored in the second memory and displaying the calculated odds on the display;

(b) calculating the odds using the configuration program stored in the second memory at expiration of the bet accepting period, paying back the bet amount to the station having placed a bet on the odds in a case where the odds is not greater than a predetermined threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

2. A gaming system comprising:

a display for displaying images relating to a racing game;

a plurality of terminals having an input device for accepting bet amount for each character that is input by a player within a timer-controlled accepting period, and outputting the accepted bet amount;

a first memory for storing the bet amount for each of the terminals that is output by the input device;

a second memory for storing a configuration program for setting odds associated with the each character;

a third memory wherein a predetermined proportion can be rewritten on the basis of an access privilege;

a controller for executing the racing game, and generating and displaying on the display a moving image in real time regarding progress of a race from the beginning to the end of the game; and a communication network device allowing intercommunication between the plurality of terminals and the controller, wherein the controller executes processing of:

(a) receiving bet amount in a bet accepting period from the input device via the communication interface and storing the bet amount in the first memory, while, in response to the reception of the bet amount or regularly at predetermined intervals, calculating the odds for winning of the each character by using the configuration program stored in the second memory and displaying the calculated odds on the display;

(b) calculating the odds using the configuration program stored in the second memory at expiration of the bet accepting period, paying back the bet amount to the station having placed a bet on the odds in a case where the odds is not greater than a predetermined threshold stored in the third memory, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

3. A gaming system comprising:

a display for displaying images relating to a racing game;

a plurality of terminals having an input device for accepting bet amount for each character that is input by a player within a timer-controlled accepting period, and outputting the accepted bet amount;

a first memory for storing the bet amount for each of the terminals that is output by the input device;

a second memory for storing a configuration program for setting odds associated with the each character;

a controller for executing the racing game, and generating and displaying on the display a moving image in real time regarding progress of a race from the beginning to the end of the game; and a communication network device allowing intercommunication between the plurality of terminals and the controller, wherein the controller executes processing of:

(a) receiving bet amount in a bet accepting period from the input device via the communication interface and storing the bet amount in the first memory, while, in response to the reception of the bet amount or regularly at predetermined intervals, calculating the odds for winning of the each character by using the configuration program stored in the second memory, preventing odds being not greater than a first threshold from being displayed on the display, and displaying the other odds on the display;

(b) calculating the odds using the configuration program stored in the second memory at expiration of the bet accepting period, paying back the bet amount to the station having placed a bet on the odds in a case where the odds is not greater than a second threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

4. A gaming system comprising:

a display for displaying images relating to a racing game;

a plurality of terminals having an input device for accepting bet amount for each character that is input by a player within a timer-controlled accepting period, and outputting the accepted bet amount;

a first memory for storing a value obtained by subtracting from the bet amount a predetermined proportion thereof, the bet amount is specified by each of the terminals and is output by the input device;

a second memory for storing a configuration program for setting odds associated with the each character;

a fourth memory for storing the predetermined proportion of the bet amount;

a controller for executing the racing game, and generating and displaying on the display a moving image in real time regarding progress of a race from the beginning to the end of the game; and a communication network device allowing intercommunication between the plurality of terminals and the controller, wherein the controller executes processing of:

(a) receiving bet amount in a bet accepting period from the input device via the communication interface, storing the value obtained by subtracting from a bet amount the predetermined proportion thereof in the first memory, and storing the predetermined proportion in the fourth memory, while, in response to the reception of the bet amount or regularly at predetermined intervals, calculating the odds for winning of the each character by using the configuration program stored in the second memory and displaying the calculated odds on the display;

(b) calculating the odds using the configuration program stored in the second memory at expiration of the bet accepting period, providing credits accumulated in the fourth memory to the station having placed a bet on the odds by a processing randomly making a determination in a case where the odds is not greater than a predetermined threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

5. A gaming system comprising:

a display for displaying images relating to a racing game;

a plurality of terminals having an input device for accepting bet amount for each character that is input by a player within a timer-controlled accepting period, and outputting the accepted bet amount;

a first memory for storing a value obtained by subtracting from the bet amount a predetermined proportion thereof, the bet amount is specified by each of the terminals and is output by the input device;

a second memory for storing a configuration program for setting odds associated with the each character;

a fourth memory for storing the predetermined proportion of the bet amount;

a controller for executing the racing game, and generating and displaying on the display a moving image in real time regarding progress of a race from the beginning to the end of the game; and a communication network device allowing intercommunication between the plurality of terminals and the controller, wherein the controller executes processing of:

(a) receiving bet amount in a bet accepting period from the input device via the communication interface, storing the value obtained by subtracting from a bet amount the predetermined proportion thereof in the first memory, and storing the predetermined proportion in the fourth memory, while, in response to the reception of the bet amount or regularly at predetermined intervals, calculating the odds for winning of the each character by using the configuration program stored in the second memory and displaying the calculated odds on the display;

(b) providing credits by any one of the following steps of:

calculating the odds using the configuration program stored in the second memory at expiration of the bet accepting period, providing credits equivalent to the bet amount or to a predetermined proportion of the bet amount to the station having placed a bet on the odds in a case where the odds is not greater than a predetermined threshold;

providing credits of which amount is obtained by multiplying the bet amount by a value randomly selected from a predetermined range;

providing credits accumulated in the fourth memory by a random determination; and providing credits for a jackpot award having at least 2 stages with different values by a random determination, and eliminating the bet for the odds from bets being qualified for an award, and (c) providing an award to a station that is qualified therefor, when a race is determined to be finished, on the basis of the bet amount and the odds.

6. A gaming method for executing a game with a gaming machine, wherein the gaming machine comprises:

a display for displaying images relating to a racing game;

a plurality of terminals having an input device for accepting bet amount for each character that is input by a player within a timer-controlled accepting period, and outputting the accepted bet amount;

a first memory for storing the bet amount for each of the terminals that is output by the input device;

a second memory for storing a configuration program for setting odds associated with the each character;

a controller for executing the racing game, and generating and displaying on the display a moving image in real time regarding progress of a race from the beginning to the end of the game; and a communication network device allowing intercommunication between the plurality of terminals, the method executed by the controller, comprising:

(a) receiving bet amount in a bet accepting period from the input device via the communication interface and storing the bet amount in the first memory, while, in response to the reception of the bet amount or regularly at predetermined intervals, calculating the odds for winning of the each character by using the configuration program stored in the second memory and displaying the calculated odds on the display;

(b) calculating the odds using the configuration program stored in the second memory at expiration of the bet accepting period, paying back the bet amount to the station having placed a bet on the odds in a case where the odds is not greater than a predetermined threshold, and eliminating the bet for the odds from bets being qualified for an award; and (c) providing an award when a race is determined to be finished, on the basis of a finishing order of the character, a type of a bet made on each of the plurality of terminals, and an amount of a bet qualified for the award.

* * * * *